US011085446B2

(12) United States Patent
Shikano et al.

(10) Patent No.: US 11,085,446 B2
(45) Date of Patent: Aug. 10, 2021

(54) BEARING FOR A SCREW ROTOR OF A SCREW COMPRESSOR

(71) Applicant: DAIKIN INDUSTRIES, LTD., Osaka (JP)

(72) Inventors: Shigeharu Shikano, Osaka (JP); Harunori Miyamura, Osaka (JP); Kazuki Mori, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 147 days.

(21) Appl. No.: 16/477,039

(22) PCT Filed: Feb. 20, 2018

(86) PCT No.: PCT/JP2018/006028
§ 371 (c)(1),
(2) Date: Jul. 10, 2019

(87) PCT Pub. No.: WO2018/151319
PCT Pub. Date: Aug. 23, 2018

(65) Prior Publication Data

US 2019/0331114 A1 Oct. 31, 2019

(30) Foreign Application Priority Data

Feb. 20, 2017 (JP) ..... JP2017-028579

(51) Int. Cl.
*F03C 2/00* (2006.01)
*F03C 4/00* (2006.01)
(Continued)

(52) U.S. Cl.
CPC ..... *F04C 18/52* (2013.01); *F04C 18/16* (2013.01); *F04C 28/12* (2013.01); *F04C 2240/52* (2013.01); *F04C 2240/605* (2013.01)

(58) Field of Classification Search
CPC ..... F04C 18/16; F04C 18/52; F04C 27/009; F04C 28/12; F04C 29/0021; F04C 29/02;
(Continued)

(56) References Cited

U.S. PATENT DOCUMENTS 3,796,526 A 3/1974 Cawley
5,599,176 A 2/1997 Reinersmann
(Continued)

FOREIGN PATENT DOCUMENTS

JP 6-42475 A 2/1994
JP 2015-38334 A 2/2015
JP 2017-15054 A 1/2017

OTHER PUBLICATIONS

European Search Report of corresponding EP Application No. 18 75 3919.2 dated May 26, 2020.
(Continued)

*Primary Examiner* — Theresa Trieu
(74) *Attorney, Agent, or Firm* — Global IP Counselors, LLP

(57) ABSTRACT

A screw compressor includes a casing, a motor provided in the casing, a screw rotor inserted into a cylinder in the casing, a bearing holder, a drive shaft, a first bearing, and a second bearing. The cylinder is formed on a lateral side of the motor. The bearing holder is disposed on an opposite side of the screw rotor from the motor and adjacent to the screw rotor. The drive shaft is connected to the motor and the screw rotor. The first bearing is disposed adjacent to the screw rotor. The second bearing is disposed adjacent to the motor in an axial direction of the drive shaft. At least a portion of the first bearing is disposed inside the screw rotor.

1 Claim, 13 Drawing Sheets

(51) Int. Cl.

| | |
|---|---|
| ***F04C 18/00*** | (2006.01) |
| ***F04C 2/00*** | (2006.01) |
| ***F04C 18/52*** | (2006.01) |
| ***F04C 18/16*** | (2006.01) |
| ***F04C 28/12*** | (2006.01) |

(58) Field of Classification Search
CPC ..... F04C 29/06; F04C 29/065; F04C 29/066; F04C 29/068; F04C 2240/50; F04C 2240/54; F04C 2240/60
See application file for complete search history.

(56) References Cited

U.S. PATENT DOCUMENTS

| | | | | |
|---|---|---|---|---|
| 2012/0003113 | A1* | 1/2012 | Shikano ..... | F04C 18/52 418/195 |
| 2012/0100028 | A1* | 4/2012 | Matsumoto ..... | F04C 18/52 418/195 |
| 2015/0308458 | A1* | 10/2015 | Ueno ..... | F04C 18/52 418/195 |
| 2018/0017058 | A1* | 1/2018 | Shikano ..... | F04C 18/16 |

OTHER PUBLICATIONS

International Preliminary Report of corresponding PCT Application No. PCT/JP2018/006028 dated Aug. 29, 2019.
International Search Report of corresponding PCT Application No. PCT/JP2018/006028 dated May 22, 2018.

* cited by examiner

BEARING FOR A SCREW ROTOR OF A SCREW COMPRESSOR

CROSS-REFERENCE TO RELATED APPLICATIONS

This U.S. National stage application claims priority under 35 U.S.C. § 119(a) to Japanese Patent Application No. 2017-028579, filed in Japan on Feb. 20, 2017, the entire contents of which are hereby incorporated herein by reference.

TECHNICAL FIELD

The present invention relates to a screw compressor, and in particular, to a bearing structure of a drive shaft.

BACKGROUND ART

Screw compressors including a compression mechanism having a screw rotor and a gate rotor have been known.

Japanese Unexamined Patent Publication No. 2015-038334 discloses a screw compressor of this type. In this screw compressor, as shown in FIG. 13, bearings (161, 166) are arranged on a drive shaft (121) at each side of a screw rotor (140), so that the bearings (161, 166) receive a force generated by compression. A bearing holder (160) is disposed adjacent to the screw rotor (140).

SUMMARY

To increase the size of the compressor, the screw rotor (40) and the drive shaft (21) having a lager diameter are used. Accordingly, the bearings (61, 66) are also increased in size. Further, an increase in the size of the compressor involves an increase in the length L1 of the drive shaft (21) and an increase in the distance L2 between the bearings. As a result, the load applied to the bearings (61, 66) increases, and the cost tends to be high.

The drive shaft (21) is generally made of an expensive material such as carbon steel or molybdenum steel to ensure strength. However, when such a material is used, with an increase in the length of the drive shaft (21) due to the increase in size of the compressor, the cost is increased.

The present invention has been made in view of the above problems, and it is an object of the present invention to provide a bearing structure capable of reducing an increase in length of a drive shaft even when a screw compressor is increased in size, thereby reducing an increase in cost.

A first aspect of the present invention is directed to a screw compressor including: a casing (11); a motor (12) provided in the casing (11); a screw rotor (40) inserted into a cylinder (16) in the casing (11), the cylinder (16) formed on a lateral side of the motor (12); a bearing holder (60) disposed on an opposite side of the screw rotor (40) from the motor (12) and adjacent to the screw rotor (40); a drive shaft (21) connected to the motor (12) and the screw rotor (40); and a first bearing (61) disposed adjacent to the screw rotor (40) and a second bearing (66) disposed adjacent to the motor (12) in an axial direction of the drive shaft (21).

In the compressor, at least a portion of the first bearing (61) is disposed inside the screw rotor (40).

In the first aspect of the invention, since at least a portion of the first bearing (61) is disposed inside the screw rotor (40), the distance between the bearings is shorter than in the conventional bearing structure in which the first bearing (61) is entirely located in the bearing holder (60). Since the distance between the bearings is shorter in the first aspect of the invention than in the prior art, the length of the drive shaft (21) can be made shorter in the first aspect of the invention than in the prior art.

A second aspect of the present invention is an embodiment of the first aspect. In the second aspect, the bearing holder (60) is provided with a shaft (62*a*) projecting toward the screw rotor (40), the screw rotor (40) is provided with a bearing hole (42) which has a larger diameter than the shaft (62*a*) of the bearing holder (60) and in which the shaft (62*a*) is received, the first bearing (61) is mounted between the shaft (62*a*) of the bearing holder (60) and a wall surface defining the bearing hole (42) of the screw rotor (40), and an axial end, of the drive shaft (21), adjacent to the screw rotor (40) is disposed closer to the motor (12) than a tip end of the shaft (62*a*) of the bearing holder (60) is.

In the second aspect of the invention, as shown in FIGS. 9 and 10, the shaft (62*a*) to which the first bearing (61) is mounted forms part of the bearing holder (60), and the axial end, of the drive shaft (21), adjacent to the screw rotor (40) is disposed closer to the motor (12) than the tip end of the shaft (62*a*) of the bearing holder (60) is. Therefore, the length of the drive shaft (21) is shorter than the distance between the bearings.

A third aspect of the present invention is an embodiment of the first aspect. In the third aspect, the bearing holder (60) is provided with a boss (63*b*) projecting toward the screw rotor (40), the boss (63*b*) being provided with a bearing hole (63*c*), the screw rotor (40) is provided with an inner hole (43) which has a larger diameter than the boss (63*b*) of the bearing holder (60) and in which the boss (63*b*) is received, the drive shaft (21) has a shaft end (21*a*) inserted into the boss (63*b*), and the first bearing (61) is mounted between the shaft end (21*a*) of the drive shaft (21) and a wall surface defining the bearing hole (63*c*) of the boss (63*b*).

In the third aspect of the present invention, as shown in FIG. 11, the first bearing (61) is mounted to the shaft end (21*a*), of the drive shaft (21), positioned inside the boss (63*b*) of the bearing holder (60), and the boss (63*b*) is positioned inside the inner hole (43) of the screw rotor (40). Therefore, the length of the drive shaft (21) is shorter in the third aspect of the invention than in the conventional structure in which the first bearing (61) is positioned inside the body of the bearing holder (60).

According to the present invention, at least a portion of the first bearing (61) is disposed inside the screw rotor (40). This feature enables the length of the drive shaft (21) to be made shorter in the present invention than in the prior art.

Specifically, in the conventional structure shown in FIG. 13, for example, an increase in the size of the screw compressor involves an increase in the distance (L21) between the bearings and an increase in the load applied to the bearings. Consequently, the length (L11) of the drive shaft (121) tends to be increased (to be longer than the distance between the bearings) and the bearings (161, 166) tend to be increased in size in the conventional structure. In contrast, the present invention, even when the screw compressor is increased in size, can reduce an increase in the length of the drive shaft (21), and can also reduce the increase in the size of the bearings (61, 66).

In the prior art of FIGS. 12B and 13, for example, when the screw compressor is increased in size, the cost is increased due to the increase in the length of the drive shaft (121) whose material is expensive. In contrast, in the bearing structure according to the invention, the length of the drive shaft (21) can be made shorter than in the prior art, thereby making it possible to reduce the increase in cost.

Further, even when applied to the screw compressor that is not large, the present invention provides an advantage: the length of drive shaft (21) can be made shorter than that of a compressor having the same performance, so that the cost can be reduced similarly.

According to the second aspect of the present invention, the structure in which the shaft (62*a*) is provided in the bearing holder (60) can reduce the increase in the length of the drive shaft (21), thereby making it possible to reduce an increase in cost even when the compressor is increased in size.

According to the third aspect of the present invention, the structure in which the bearing is provided in the boss (63*b*) located inside the screw rotor (40) can reduce the increase in the length of the drive shaft (21), thereby making it possible to achieve another structure (a structure different from that in the second aspect) which reduces the increase in cost even when the compressor is increased in size.

DETAILED DESCRIPTION OF EMBODIMENT(S)

Embodiments of the present invention will now be described in detail with reference to the drawings.

First Embodiment

A first embodiment of the present invention will be described.

Figure 1:
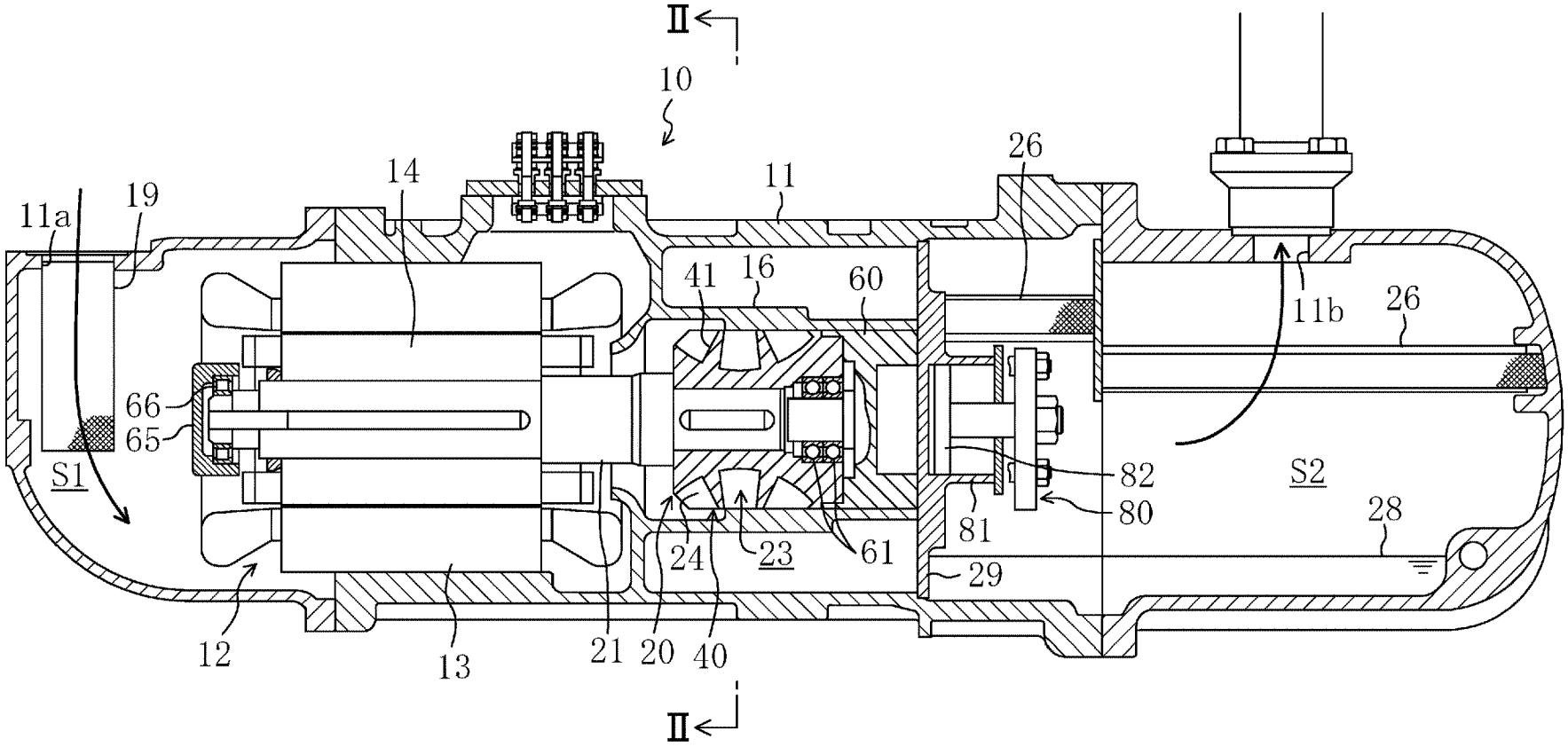
FIG. 1 is a vertical cross-sectional view of a screw compressor according to a first embodiment of the present invention.
Figure 2:
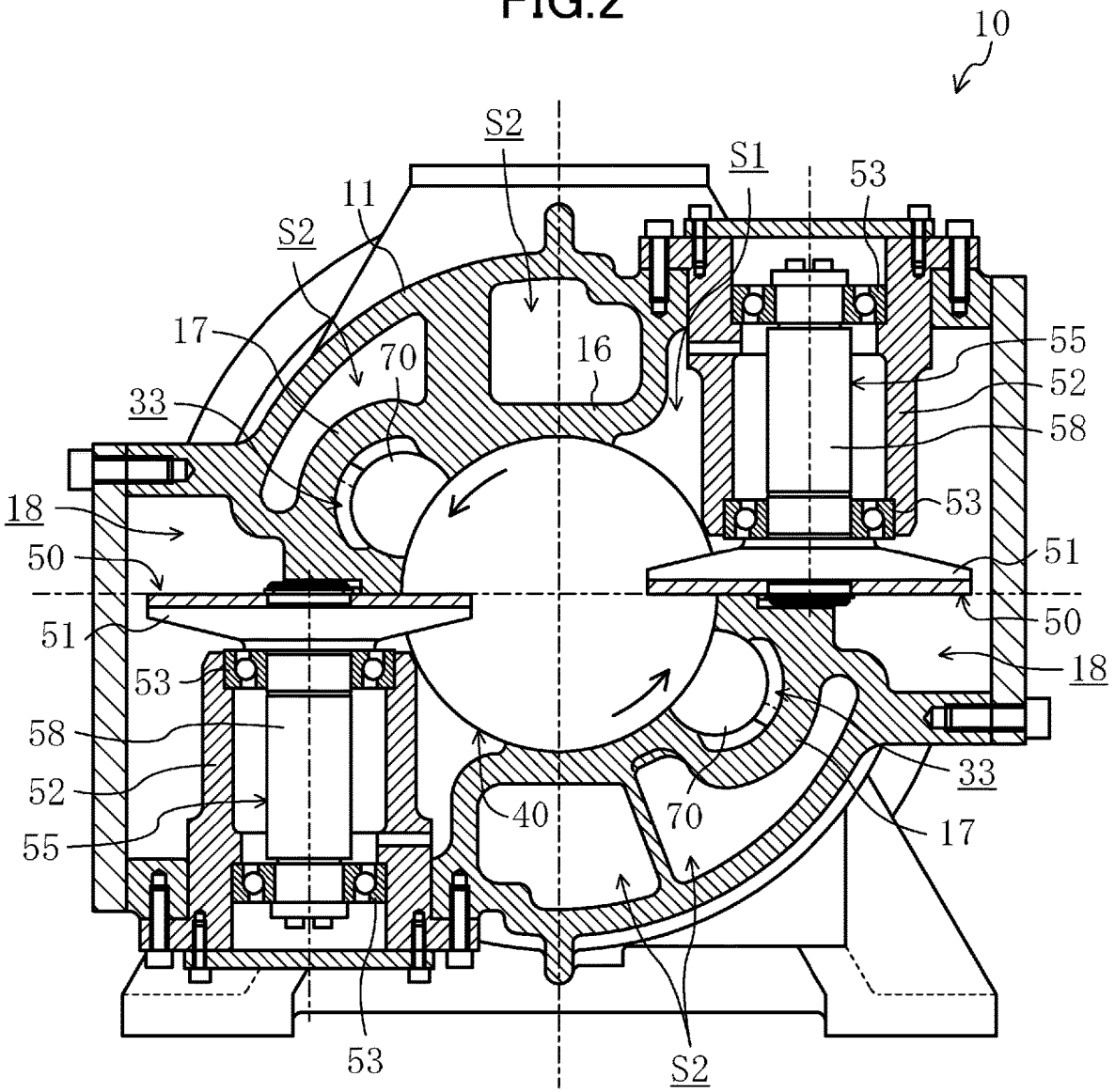
FIG. 2 is an enlarged cross-sectional view taken along line II-II of FIG. 1.
Figure 3:
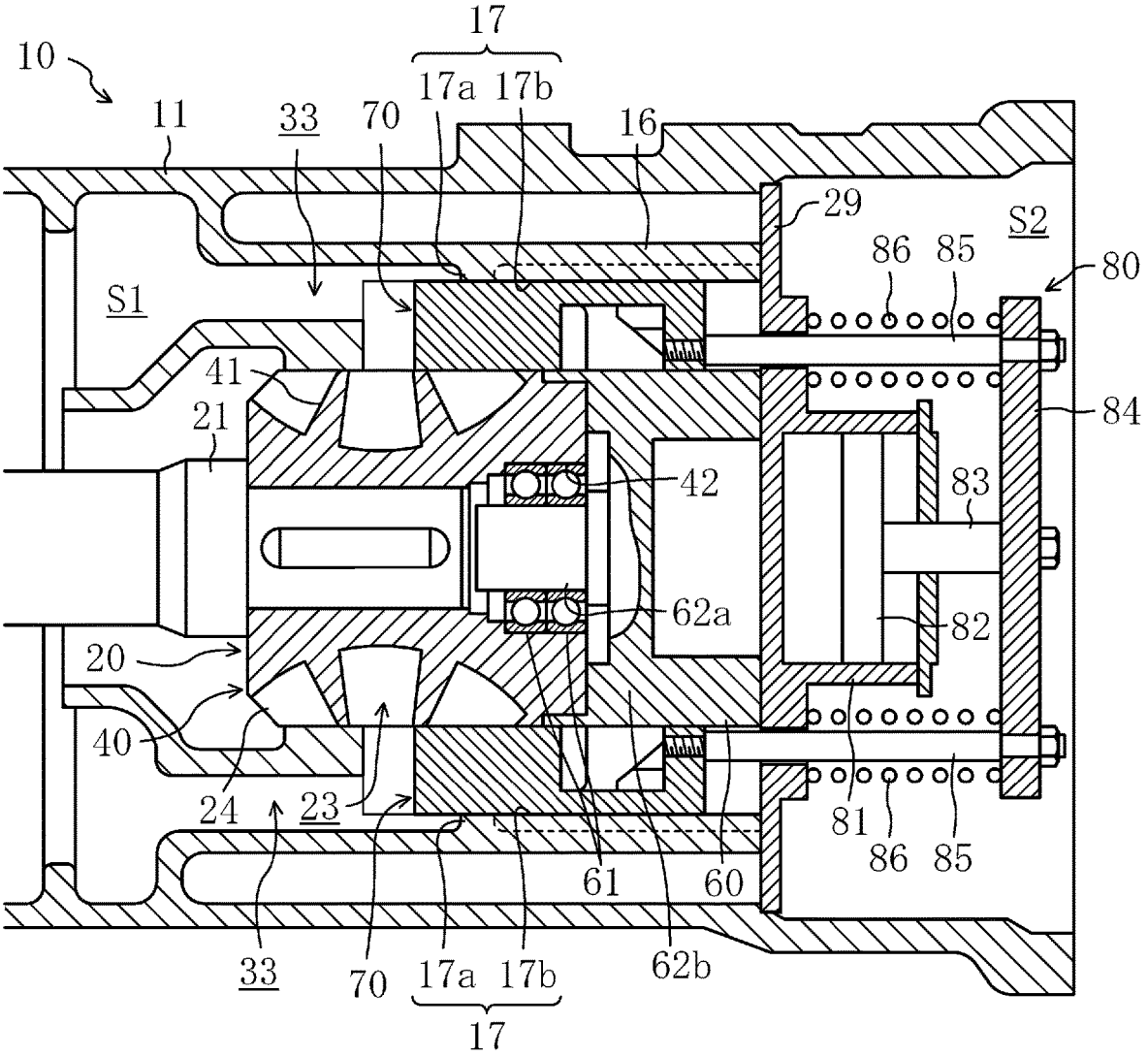
FIG. 3 is an enlarged cross-sectional view of a main part of FIG. 1.

FIG. 1 is a vertical cross-sectional view showing a configuration of a screw compressor. FIG. 2 is its horizontal cross-sectional view. FIG. 3 is an enlarged cross-sectional view of a main part of FIG. 1. As shown in FIGS. 1 and 2, in a screw compressor (10), a compression mechanism (20) and a motor (12) for driving the compression mechanism (20) are housed in a metal casing (11). The compression mechanism (20) is connected to the motor (12) via a drive shaft (21).

The casing (11) includes therein a low-pressure space (S1) into which a low-pressure gas refrigerant flows and a high-pressure space (S2) into which a high-pressure gas refrigerant that has been discharged from the compression mechanism (20) flows.

A suction port (11*a*) is formed in a portion of the casing (11), the portion being adjacent to the low-pressure space (S1). A suction-side filter (19) is attached to the suction port (11*a*), and collects relatively large foreign matter contained in the gas refrigerant to be sucked into the casing (11).

The motor (12) includes a stator (13) and a rotor (14). The stator (13) is fixed to the inner peripheral surface of the casing (11) in the low-pressure space (S1). The rotor (14) is connected to one end of the drive shaft (21), which rotates together with the rotor (14).

The compression mechanism (20) includes a cylinder (16) formed in the casing (11), one screw rotor (40) disposed inside the cylinder (16), and two gate rotors (50) meshing with the screw rotor (40).

The screw rotor (40) is a metal member having a generally cylindrical shape. The outer diameter of the screw rotor (40) is slightly smaller than the inner diameter of the cylinder (16), and the outer peripheral surface of the screw rotor (40) is close to the inner peripheral surface of the cylinder (16). The screw rotor (40) has, on its outer peripheral portion, a plurality of helical grooves (41) helically extending from one axial end toward the other axial end of the screw rotor (40). The drive shaft (21) is connected to the screw rotor (40).

One end of the drive shaft (21) is rotatably supported on a bearing (a second bearing) (66) adjacent to the low-pressure space (hereinafter referred to as "the low-pressure-side bearing (66)"). The low-pressure-side bearing (66) is held by a bearing holder (65) adjacent to the low-pressure space (hereinafter referred to as "the low-pressure-side bearing holder (65)"). The other end of the drive shaft (21) is connected to the screw rotor (40). The screw rotor (40) is rotatably supported by a bearing holder (60), adjacent to the high-pressure space (hereinafter referred to as "the high-pressure-side bearing holder (60)"), via a bearing (a first bearing) (61) adjacent to the high-pressure space (hereinafter referred to as "the high-pressure-side bearing (61)"). The high-pressure-side bearing holder (60) is fitted into, and held by, the cylinder (16) of the casing (11).

The other end of the drive shaft (21) is formed to have a length such that the other end of the drive shaft (21) is partially inserted into the screw rotor (40). The high-pressure-side bearing holder (60) has a shaft (62*a*) projecting toward the screw rotor (40) and inserted into the screw rotor (40) from a side away from the drive shaft (21). The tip end surface of the shaft (62*a*) faces, and is spaced apart from, the end surface of the drive shaft (21). The shaft (62*a*) of the high-pressure-side bearing holder (60) is formed integrally with a bearing holder body (62*b*). The screw rotor (40) is provided with a bearing hole (42) which has a larger diameter than the shaft (62*a*) of the bearing holder (60) and in which the shaft (62*a*) is received. The high-pressure-side bearing (61) is mounted between the shaft (62*a*) of the bearing holder (60) and the wall surface defining the bearing hole (42) of the screw rotor (40). The axial end, of the drive shaft (21), adjacent to the screw rotor (40) is closer to the motor (12) than the tip end of the shaft (62*a*) of the bearing holder (60) is.

Specifically, the high-pressure-side bearing (61) has an inner ring into which the shaft (62*a*) is inserted, and an outer ring which is inserted into the bearing hole (42) of the screw rotor (40). In this embodiment, the assembly is carried out by fixing the inner ring of the high-pressure-side bearing (61) to the shaft (62*a*).

In the prior art, the high-pressure-side bearing (61) is provided inside the body of the bearing holder (60), and the drive shaft (21) has a length so as to range from the interior of the low-pressure-side bearing holder (65) to the interior of the high-pressure-side bearing holder (60). By contrast, in this embodiment, the high-pressure-side bearing (61) is disposed inside the screw rotor (40) (and closer to the motor (12) than the boundary between the screw rotor (40) and the high-pressure-side bearing holder (60) is). The drive shaft (21) of this embodiment is shorter than that of the conventional screw compressor such that the drive shaft (21) of this embodiment ranges from the interior of the low-pressure-side bearing holder (65) to the interior of the screw rotor (40).

Figure 4:
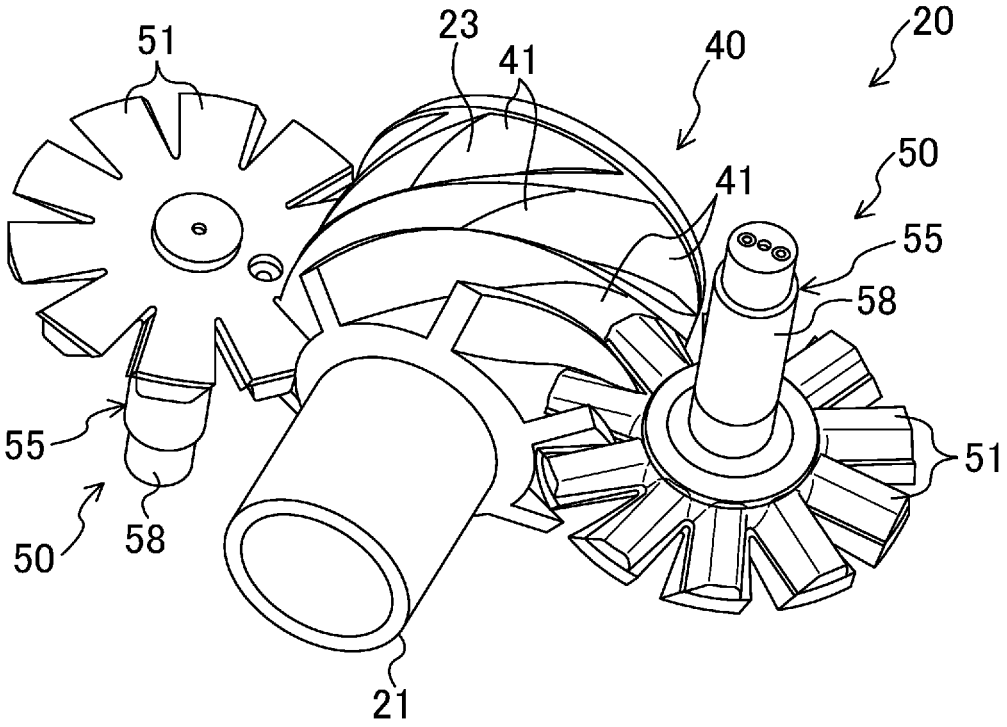
FIG. 4 is a perspective view showing how a screw rotor and gate rotors mesh with each other.
Figure 5:
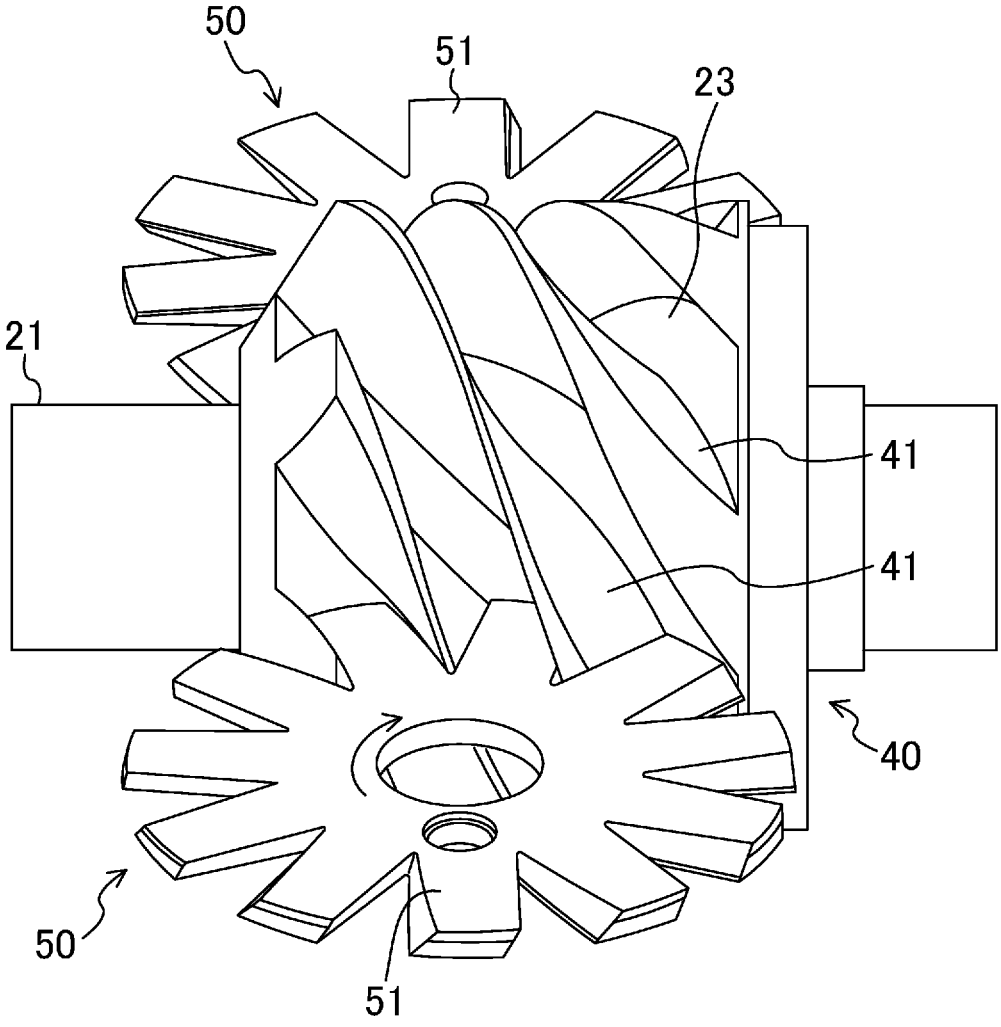
FIG. 5 is a perspective view showing, from a different angle, how the screw rotor and the gate rotors mesh with each other.

FIGS. 4 and 5 are perspective views showing how the screw rotor (40) and the gate rotors (50) mesh with each other. The gate rotor (50) has a plurality of gates (51) extending radially. The gate rotor (50) is attached to a metal rotor support member (55). The rotor support member (55) is housed in a gate rotor chamber (18) defined in the casing (11) and adjacent to the cylinder (16). The gate rotor chamber (18) forms part of the low-pressure space (S1).

The rotor support member (55) shown on the right of the screw rotor (40) in FIGS. 2 and 4 is disposed such that the gate rotor (50) faces downward. On the other hand, the rotor support member (55) shown on the left of the screw rotor (40) in FIGS. 2 and 4 is disposed such that the gate rotor (50) faces upward. The shaft (58) of each rotor support member (55) is rotatably supported, via ball bearings (53), by a bearing housing (52) in the gate rotor chamber (18).

In the compression mechanism (20), the inner peripheral surface of the cylinder (16), the helical grooves (41) of the screw rotor (40), and the gates (51) of the gate rotors (50) surround a compression chamber (23). Each helical groove (41) of the screw rotor (40) opens, at its suction side end, to the low-pressure space (S1), and this open portion functions as a suction port (24) of the compression mechanism (20).

As shown in FIG. 1, an oil reservoir (28) is provided on the bottom, of the casing (11), adjacent to the high-pressure space (S2). The oil stored in the oil reservoir (28) is used for lubricating the drive components such as the screw rotor (40). The space in which the compression mechanism (20) is disposed is separated from the oil reservoir (28) by a fixing plate (29).

A discharge port (11*b*) is provided in an upper portion of the casing (11), the upper portion being adjacent to the high-pressure space (S2). An oil separator (26) is disposed above the oil reservoir (28). The oil separator (26) separates oil from the high-pressure refrigerant. Specifically, when the high-pressure refrigerant that has been compressed in the compression chamber (23) passes through the oil separator (26), the oil contained in the high-pressure refrigerant is captured by the oil separator (26). The oil that has been captured by the oil separator (26) is collected in the oil reservoir (28). On the other hand, the high-pressure refrigerant from which the oil has been separated is discharged out of the casing (11) through the discharge port (11*b*).

As shown in FIG. 3, the screw compressor (10) is provided with slide valves (70) for adjusting the capacity. Each slide valve (70) is housed in a corresponding one of valve housings (17) that are two circumferential portions, of the cylinder (16), protruding radially outwardly (see FIG. 2). The slide valves (70) are slidable along the axis of the cylinder (16), and face the outer peripheral surface of the screw rotor (40) when being inserted in the valve housings (17).

The screw compressor (10) is provided with a slide valve driving mechanism (80) configured to drive and slide the slide valves (70). The slide valve driving mechanism (80) includes: a cylinder (81) formed on a right sidewall surface of the fixing plate (29); a piston (82) fitted in the cylinder (81), an arm (84) connected to a piston rod (83) of the piston (82); connecting rods (85) connecting the arm (84) to the slide valves (70); and springs (86) biasing the arm (84) rightward in FIG. 3.

The slide valve driving mechanism (80) is configured to adjust the position of the slide valves (70) by controlling the movement of the piston (82) through regulation of the gas pressure applied to right and left end faces of the piston (82).

When the slide valve (70) moves toward the high-pressure space (S2), an axial gap is formed between the end face of the valve housing (17) and the end face of the slide valve (70). The axial gap constitutes a bypass passage (33) through which the refrigerant is returned to the low-pressure space (S1) from the compression chamber (23). That is to say, one end of the bypass passage (33) communicates with the low-pressure space (S1), and the other end opens to the inner peripheral surface of the cylinder (16). When the end face of the valve housing (17) and the end face of the slide valve (70) are separated from each other, the gap formed therebetween serves as an opening of the bypass passage (33) on the inner peripheral surface of the cylinder (16).

When the slide valve (70) moves, the area of the opening of the bypass passage (33) changes, thereby changing the flow rate of the refrigerant flowing from the compression chamber (23) through the bypass passage (33) to the low-pressure space (S1). That is to say, when the slide valve (70) is slid, the start time point of the compression stroke is changed, resulting in a change in the amount of refrigerant discharged from the compression chamber (23) per unit time (i.e., a change in the operating capacity of the screw compressor (10)).

As shown in FIG. 3, the outer peripheral wall of the valve housing (17) includes: a partition wall (17*a*) separating the low-pressure space (S1) from the high-pressure space (S2); and a guide wall (17*b*) extending axially from the central position in the width direction of the partition wall (17*a*) toward the high-pressure space (S2).

The cylinder (16) is provided with a fixed discharge port (not shown) always communicating with the compression chamber (23) regardless of the position of the slide valve (70). This fixed discharge port is provided so as to keep the compression chamber (23) from being hermetically closed in order to substantially avoid liquid compression at the timing when the screw compressor (10) is actuated or is at a low load.

—Operation—

It will be described how the screw compressor (10) operates. When the motor (20) is driven, the drive shaft (21) and the screw rotor (40) rotate. When the screw rotor (40) rotates, the gate rotor (50) meshing with the helical grooves (41) rotates. Thus, in the compression mechanism (20), the suction stroke, the compression stroke, and the discharge stroke are continuously repeated. These strokes will be described with reference to FIGS. 6 to 8.

Figure 6:
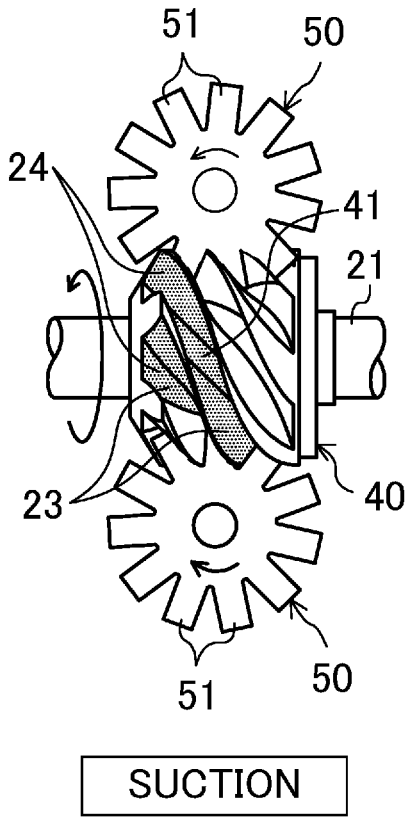
FIG. 6 is a plan view schematically showing a suction stroke of the screw compressor.

In the suction stroke shown in FIG. 6, the compression chamber (23) (strictly speaking, the suction chamber), which is shaded, communicates with the low-pressure space (S1). The helical groove (41) corresponding to the compression chamber (23) meshes with the gate (51) of the gate rotor (50). When the screw rotor (40) rotates, the gate (51) relatively moves toward the terminal end of the helical groove (41), causing the volume of the compression chamber (23) to increase. As a result, the low-pressure refrigerant in the low-pressure space (S1) is sucked into the compression chamber (23) through the suction port (24).

Figure 7:
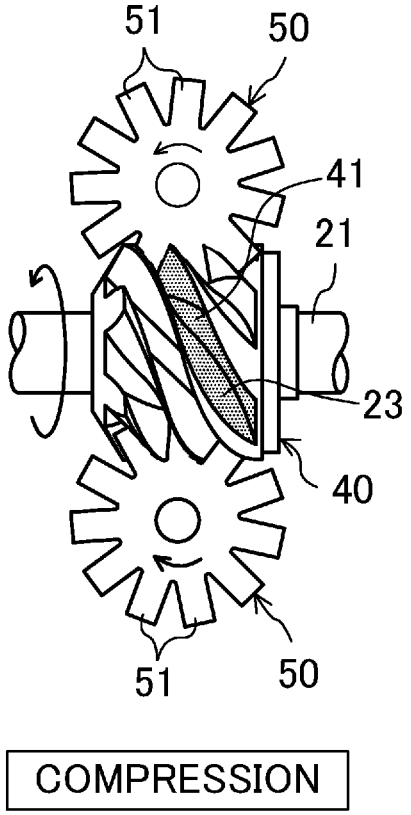
FIG. 7 is a plan view schematically showing a compression stroke of the screw compressor.

When the screw rotor (40) further rotates, the compression stroke shown in FIG. 7 is performed. In the compression stroke, the shaded compression chamber (23) is closed. That is to say, the helical groove (41) corresponding to the compression chamber (23) is separated from the low-pressure space (S1) by the gate (51). When the gate (51) approaches the terminal end of the helical groove (41) in accordance with the rotation of the screw rotor (40), the volume of the compression chamber (23) gradually decreases. As a result, the refrigerant in the compression chamber (23) is compressed.

Figure 8:
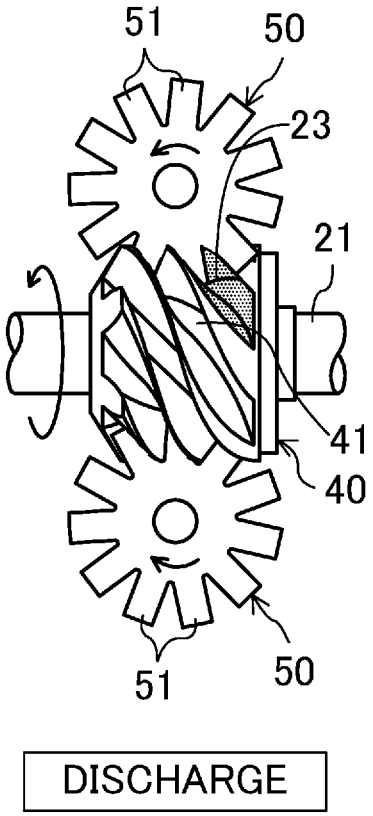
FIG. 8 is a plan view schematically showing a discharge stroke of the screw compressor.

When the screw rotor (40) further rotates, the discharge stroke shown in FIG. 8 is performed. In the discharge stroke, the compression chamber (23) (strictly speaking, the discharge chamber), which is shaded, communicates with the fixed discharge port via the end adjacent to the discharge side (the right end in the figure). When the gate (51) approaches the terminal end of the helical groove (41) in accordance with the rotation of the screw rotor (40), the refrigerant that has been compressed is pushed out from the compression chamber (23) through the fixed discharge port to the high-pressure space (S2).

When the slide valve mechanism (80) adjusts the position of the slide valve (70), the flow rate of the refrigerant (the circulation rate of the refrigerant) to be sent from the compression mechanism (20) to the high-pressure space (S2) is adjusted. For example, if the motor (12) is of the inverter type, the compression ratio of the compression mechanism (20) may be adjusted through adjustment of the position of the slide valve (70).

—Advantages of First Embodiment—

Figure 9:
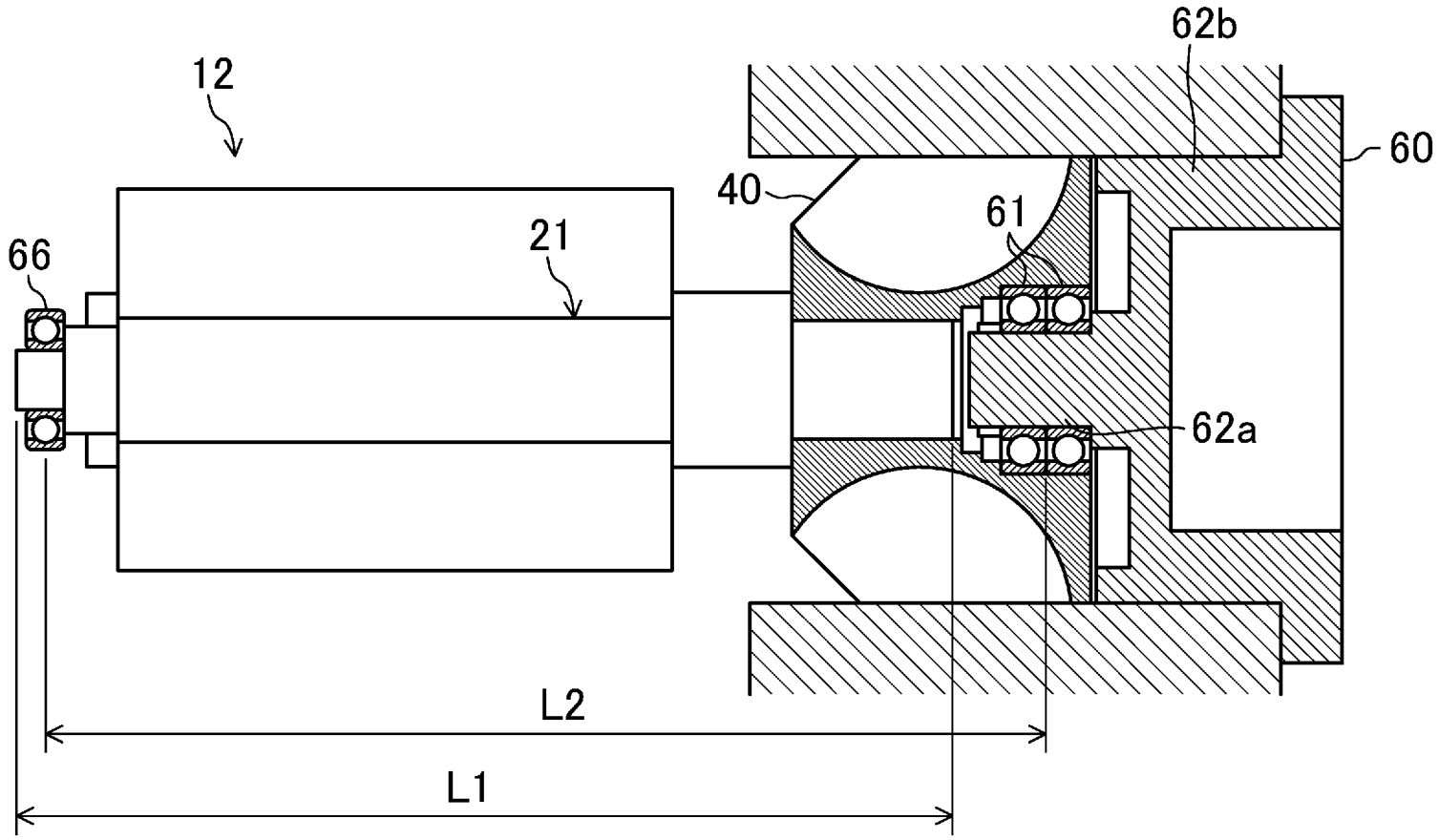
FIG. 9 is a cross-sectional view of a main part of the screw compressor, and shows the shape of a drive shaft and a bearing structure.

As described above, in this embodiment, the high-pressure-side bearing (61) is provided inside the screw rotor (40), so that the drive shaft (21) is shortened to range from the low-pressure-side bearing (66) in the low-pressure-side bearing holder (65) to the interior of the screw rotor (40). This feature allows, as shown in FIG. 9, the drive shaft (21) to have the length L1 shorter than the distance L2 between the bearings.

Figure 12A:
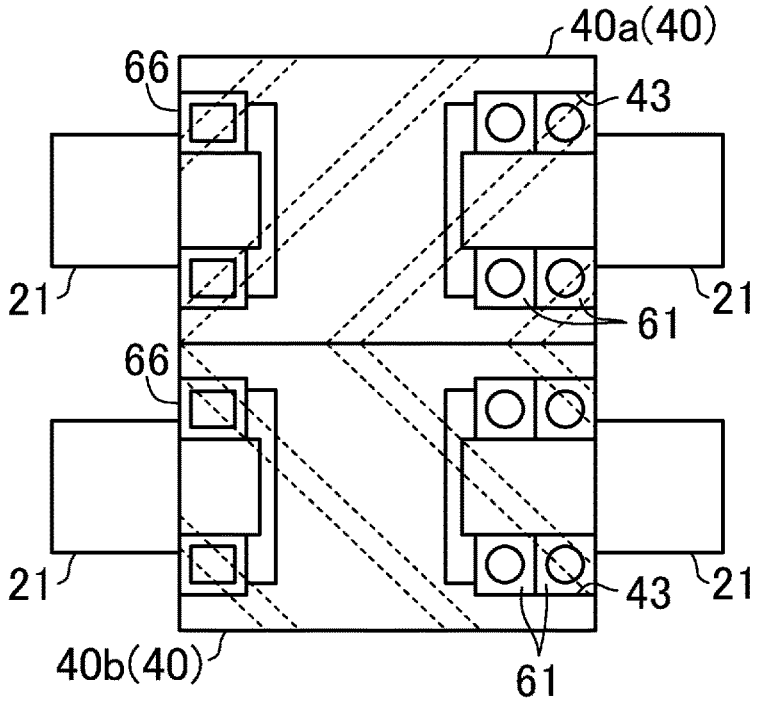
FIG. 12A is a schematic view showing a bearing structure of a twin screw compressor according to another embodiment.
Figure 12B:
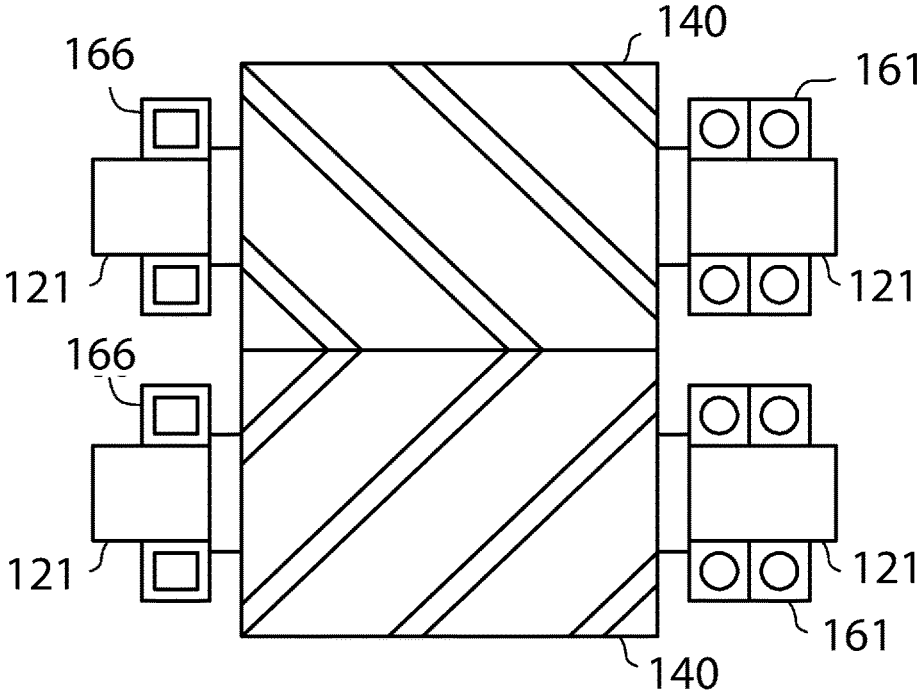
FIG.12B (PRIOR ART)
FIG. 12B is a schematic view showing a bearing structure of a twin screw compressor according to a conventional example.
Figure 13:
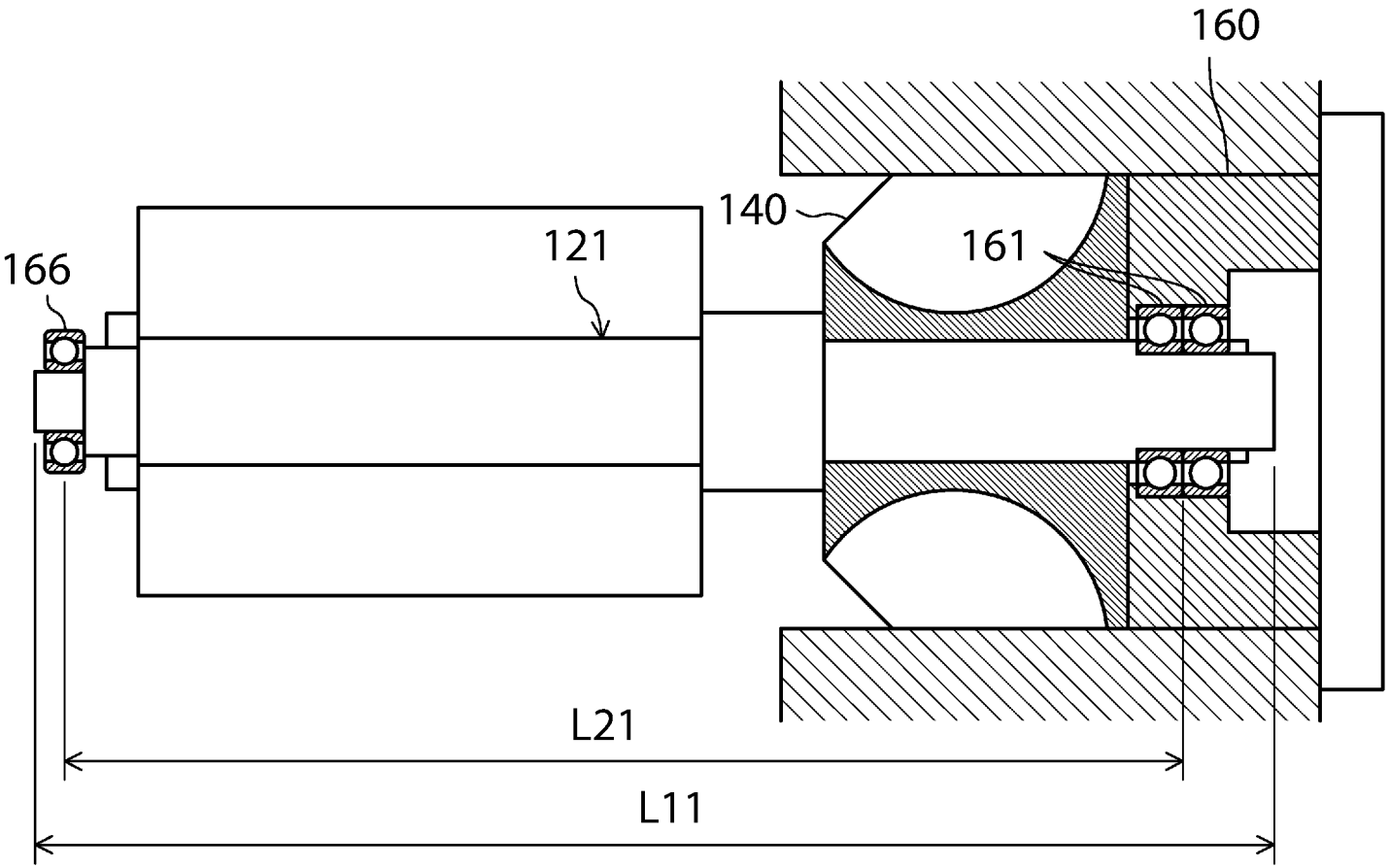
FIG.13 (PRIOR ART)
FIG. 13 is a cross-sectional view of a main part of a screw compressor according to a conventional example, and shows the shape of a drive shaft and a bearing structure.

In the conventional structure shown in FIGS. 12B and 13, for example, an increase in the size of the screw compressor involves an increase in the distance (L21) between the bearings and an increase in the load applied to the bearings (161, 166). In other words, the length (L11) of the drive shaft (121) tends to be increased (to be longer than the distance between the bearings) and the bearings (161, 166) tend to be increased in size. In contrast, according to this embodiment, as shown in FIG. 9, even when the screw compressor (10) is increased in size, the increase in the length of the drive shaft (21) can be reduced (to be shorter than the distance between the bearings), so that the increase in the size of the bearings (61, 66) can also be reduced. In the prior art, for example, when the screw compressor (10) is increased in size, the cost is increased due to the increase in the length of the drive shaft whose material is expensive. In contrast, in the bearing structure according to this embodiment, the length of the drive shaft (21) can be made shorter than that in the prior art, thereby making it possible to reduce the increase in cost.

Further, even when applied to the screw compressor (10) that is not large, this embodiment provides an advantage: the length of drive shaft (21) can be made shorter than that of a compressor (10) having the same performance, so that the cost can be reduced similarly.

—Variation of First Embodiment—

The above embodiment adopts the assembling method by which the inner ring of the high-pressure-side bearing (61) is fixed to the shaft (62*a*) of the high-pressure-side bearing holder (60). Alternatively, another assembling method by which the outer ring of the high-pressure-side bearing (61) is fixed to the wall surface defining the bearing hole (42) of the screw rotor (40) may be adopted.

Figure 10:
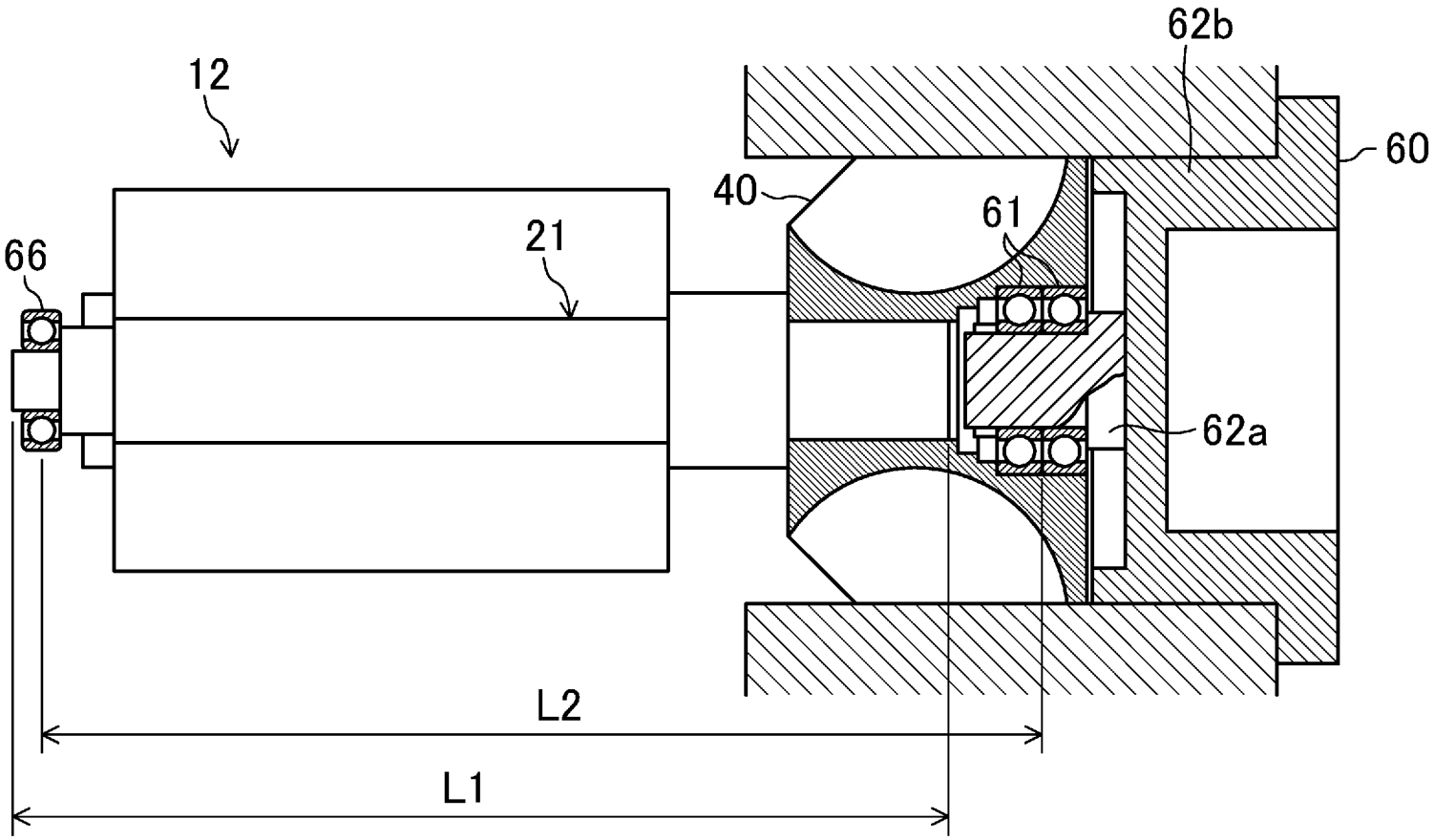
FIG. 10 is a cross-sectional view of a main part of the screw compressor according to a variation of the first embodiment, and shows the shape of a drive shaft and a bearing structure.

In the above embodiment, the high-pressure-side bearing holder (60) is comprised of the bearing holder body (62*b*) and the shaft (62*a*) that are integral with each other. Alternatively, as shown in FIG. 10, the high-pressure-side bearing holder (60) may be formed by fixing the bearing holder main body (62*b*) and the shaft (62*a*), which are separate members, to each other.

Second Embodiment

A second embodiment of the present invention will be described.

Figure 11:
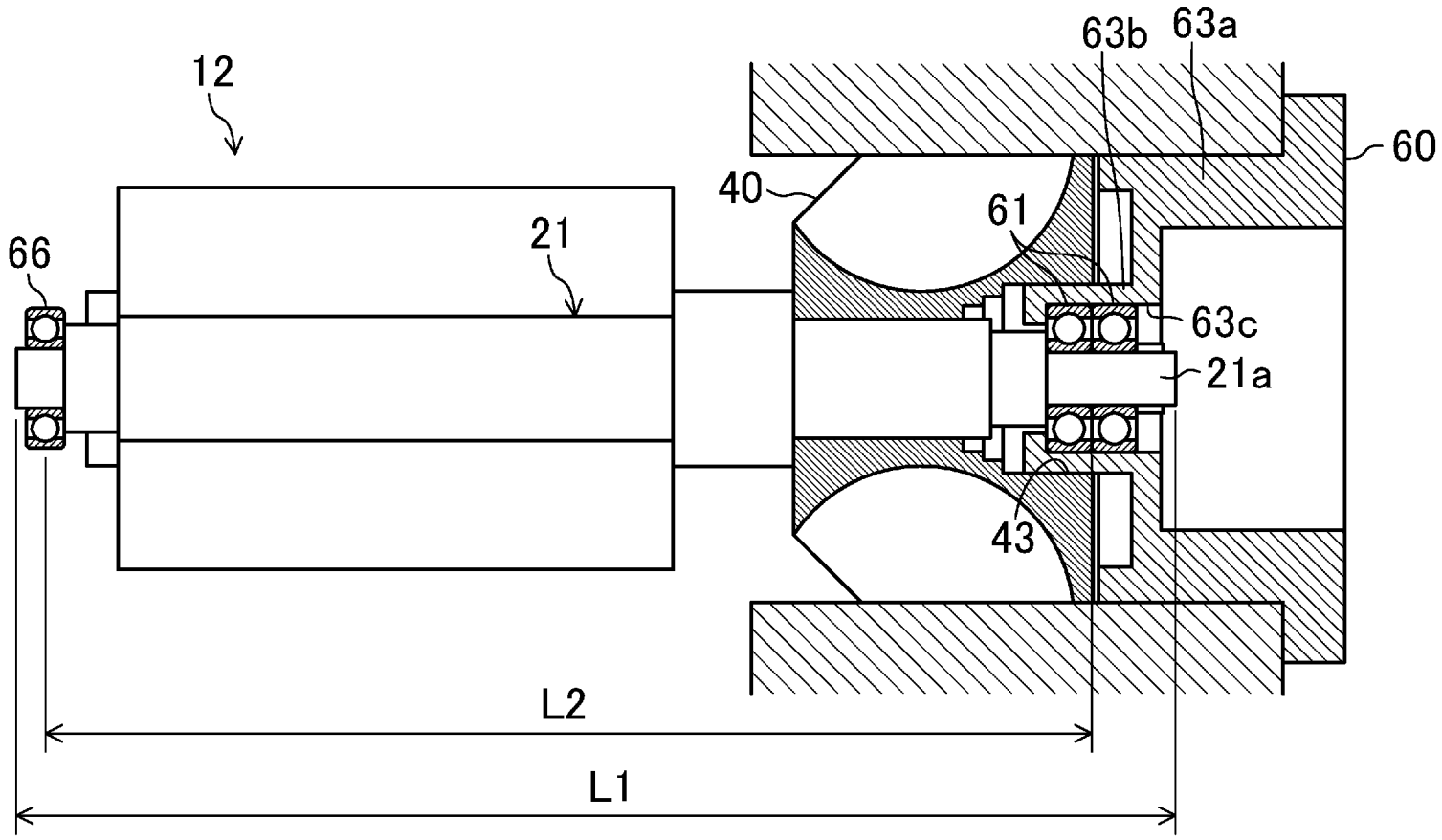
FIG. 11 is a cross-sectional view of a main part of the screw compressor according to a second embodiment, and shows the shape of a drive shaft and a bearing structure.

In the second embodiment shown in FIG. 11, a bearing holder body (63*a*) of the high-pressure-side bearing holder (60) is provided with a boss (63*b*) projecting toward the screw rotor (40), and the boss (63*b*) is provided with a bearing hole (63*c*). The screw rotor (40) is provided with an inner hole (43) which has a larger diameter than the boss (63*b*) of the high-pressure-side bearing holder (60) and in which the boss (63*b*) is received. The drive shaft (21) has a shaft end (21*a*) inserted into the boss (63*b*). The high-pressure-side bearing (61) is mounted between the shaft end (21*a*) of the drive shaft (21) and the wall surface defining the bearing hole (63*c*) of the boss (63*b*).

With the above structure, a portion of the high-pressure-side bearing (61) is disposed inside the screw rotor (40). However, in the second embodiment, the whole of the high-pressure-side bearing (61) may be disposed inside the screw rotor (40), depending on the specific structure of, e.g., the screw rotor (40).

In the second embodiment, the length L1 of the drive shaft (21) is longer than the distance L2 between the bearings. However, the high-pressure-side bearing (61) is provided in the boss (63*b*) located inside the screw rotor (40), and thus, the distance L2 between the bearings is shorter in this embodiment than in the conventional structure in which the high-pressure-side bearing (61) is provided inside the body of the bearing holder (60). Therefore, since the length L1 of the drive shaft (21) can also be made shorter in this embodiment than in the conventional structure, it is possible to reduce the cost, compared with the conventional bearing structure.

Other Embodiments

The above-described embodiments may be modified as follows.

The screw compressor according to the first embodiment is provided with the slide valves for adjusting the operating capacity (or the compression ratio). For example, the present invention may be applied to a screw compressor provided with no slide valve.

Instead of the above-described first and second embodiments, any specific structure may be adopted to dispose the high-pressure-side bearing (61) so that at least a portion thereof is located inside the screw rotor (40).

Further, the structure in which the high-pressure-side bearing (first bearing) (61) is disposed inside the screw rotor (40) may be applied to a twin screw compressor in which two screw rotors (40), namely, a first rotor (40*a*) and a second rotor (40*b*) mesh with each other, as shown in FIG. 12A. In FIG. 12A, one of the first rotor (40*a*) and the second rotor (40*b*) is a male rotor, and the other one is a female rotor. The drive shaft (21) includes a driving portion and a driven portion, and these portions are collectively referred to as the drive shaft (21).

FIG. 12B shows a bearing structure of a conventional twin screw compressor. As is clear from comparison with FIG. 12B, in the twin screw compressor shown in FIG. 12A according to the embodiment of the present disclosure, the distance between the bearings can be made shorter than that of the conventional twin screw compressor. Therefore, also for the twin screw compressor, the present invention can provide the same or similar advantages to those of the above embodiments: the increase in size of the compressor and the increase in cost are reduced.

In the example shown in FIG. 12A, the low-pressure-side bearing (second bearing) (66) is also disposed inside the screw rotor (40). Therefore, the advantage of reducing the distance between the bearings is further enhanced. In the example shown in FIG. 12A, the entire bearings (61, 66) are disposed inside the screw rotor (40). However it is suitable that at least a portion of the bearings (61, 66) is disposed inside the screw rotor (40).

Note that the foregoing description of the embodiments is a merely preferred example in nature, and is not intended to limit the scope, application, or uses of the present disclosure.

In view of the foregoing description, the present invention is useful for a bearing structure of a drive shaft of a screw compressor.

What is claimed is:

1. A screw compressor comprising:

a casing;

a motor provided in the casing;

a screw rotor inserted into a cylinder in the casing, the cylinder being formed on a lateral side of the motor;

a bearing holder disposed on an opposite side of the screw rotor from the motor, and the bearing holder being disposed adjacent to the screw rotor;

a drive shaft connected to the motor and the screw rotor; and a first bearing disposed adjacent to the screw rotor; and a second bearing disposed adjacent to the motor in an axial direction of the drive shaft, at least a portion of the first bearing being disposed inside the screw rotor, the bearing holder being provided with a shaft projecting toward the screw rotor, the screw rotor being provided with a bearing hole having a larger diameter than the shaft of the bearing holder and in which the shaft is received, the first bearing being mounted between the shaft of the bearing holder and a wall surface defining the bearing hole of the screw rotor, an axial end of the drive shaft adjacent to the screw rotor being disposed closer to the motor than a tip end of the shaft of the bearing holder, and one end of the drive shaft being rotatably supported on the second bearing, another end of the drive shaft being inserted into the screw rotor, the screw rotor being rotatably supported on the bearing holder via the first bearing, the shaft being inserted into the screw rotor from a side away from the drive shaft, and the tip end of the shaft facing, and being spaced apart from, an end surface of the drive shaft.

* * * * *